US005499559A

United States Patent [19]

Lin

[11] Patent Number: 5,499,559

[45] Date of Patent: Mar. 19, 1996

[54] STRUCTURE OF REVERSIBLE SOCKET WRENCH

[76] Inventor: Ching-Chou Lin, No. 150, Sec. 3, Chung Shan Road, Wu Jih Hsiang, Taichung Hsien, Taiwan

[21] Appl. No.: 392,325

[22] Filed: Feb. 22, 1995

[51] Int. Cl.[6] ..... B25B 13/46

[52] U.S. Cl. ..... 81/59.1; 81/58; 81/63.1; 192/44

[58] Field of Search ..... 81/59.1, 58, 63.1, 81/57.39; 192/44, 45

[56] References Cited

U.S. PATENT DOCUMENTS

| | | | |
|---|---|---|---|
| 1,904,621 | 4/1933 | Kounovsky | 81/59.1 |
| 2,003,155 | 5/1935 | Pfauser | 192/44 |
| 2,410,392 | 10/1946 | Rich | 192/44 |
| 2,707,540 | 5/1955 | Morris | 192/44 |
| 4,362,073 | 12/1982 | Cloud | 81/59.1 |
| 4,429,598 | 2/1984 | Tucker | 81/59.1 |
| 4,669,339 | 6/1987 | Cartwright | 81/59.1 |
| 4,873,898 | 10/1989 | Chern | 81/59.1 |
| 4,987,803 | 1/1991 | Chern | 81/59.1 |

*Primary Examiner*—Willis Little
*Attorney, Agent, or Firm*—Bacon & Thomas

[57] ABSTRACT

A reversible socket wrench including a handle having a box end, an adapter for mounting a socket for turning a workpiece, an adapter holder mounted within the box end and covered with a top cover plate to hold the adapter by roller bearings, a locating spring wire fastened to the adapter holder to hold it in position, and a slide moved in an arched slot on the top cover plate to shift the adapter holder between the forward operating position for allowing the adapter holder to be turned by the handle clockwise, and the backward operating position for allowing the adapter holder to be turned by the handle counter-clockwise.

1 Claim, 4 Drawing Sheets

STRUCTURE OF REVERSIBLE SOCKET WRENCH

BACKGROUND OF THE INVENTION

The present invention relates to reversible socket wrenches, and relates more particularly to such a reversible socket wrench which uses roller bearings to hold an adapter holder, which holds an adapter for mounting a socket for turning a workpiece, and a slide for controlling the forward operation and the reversed operation.

FIG. 1 shows a conventional reversible socket wrench, which is generally comprised of a handle having a box end, a ratchet member mounted within the box end for holding an adapter for mounting a socket for turning a workpiece, a pawl member mounted within the box end and meshed with the ratchet member, and an annular cover plate fastened to the box end to hold down the ratchet member and the pawl member. This structure of reversible socket wrench is still not satisfactory in function. When the handle is turned reversely relative to the ratchet member, the pawl member is forced to strike the ratchet member, causing a noise produced. Frequently striking the pawl member against the ratchet member will cause the socket wrench to wear away quickly. Furthermore, the ratchet member does not allow the socket wrench to turn the workpiece within a turning angle smaller than the pitch of the teeth of the ratchet member.

SUMMARY OF THE INVENTION

The present invention provides a reversible socket wrench which eliminates the aforesaid drawbacks. According to the present invention, roller bearings are installed in an adapter holder within the box end of the handle to hold the adapter. Therefore, the handle can be turned relative to the adapter holder stepless, and the friction between the adapter and the adapter holder is minimized.

DETAILED DESCRIPTION OF THE PREFERRED EMBODIMENT

Figure 1:
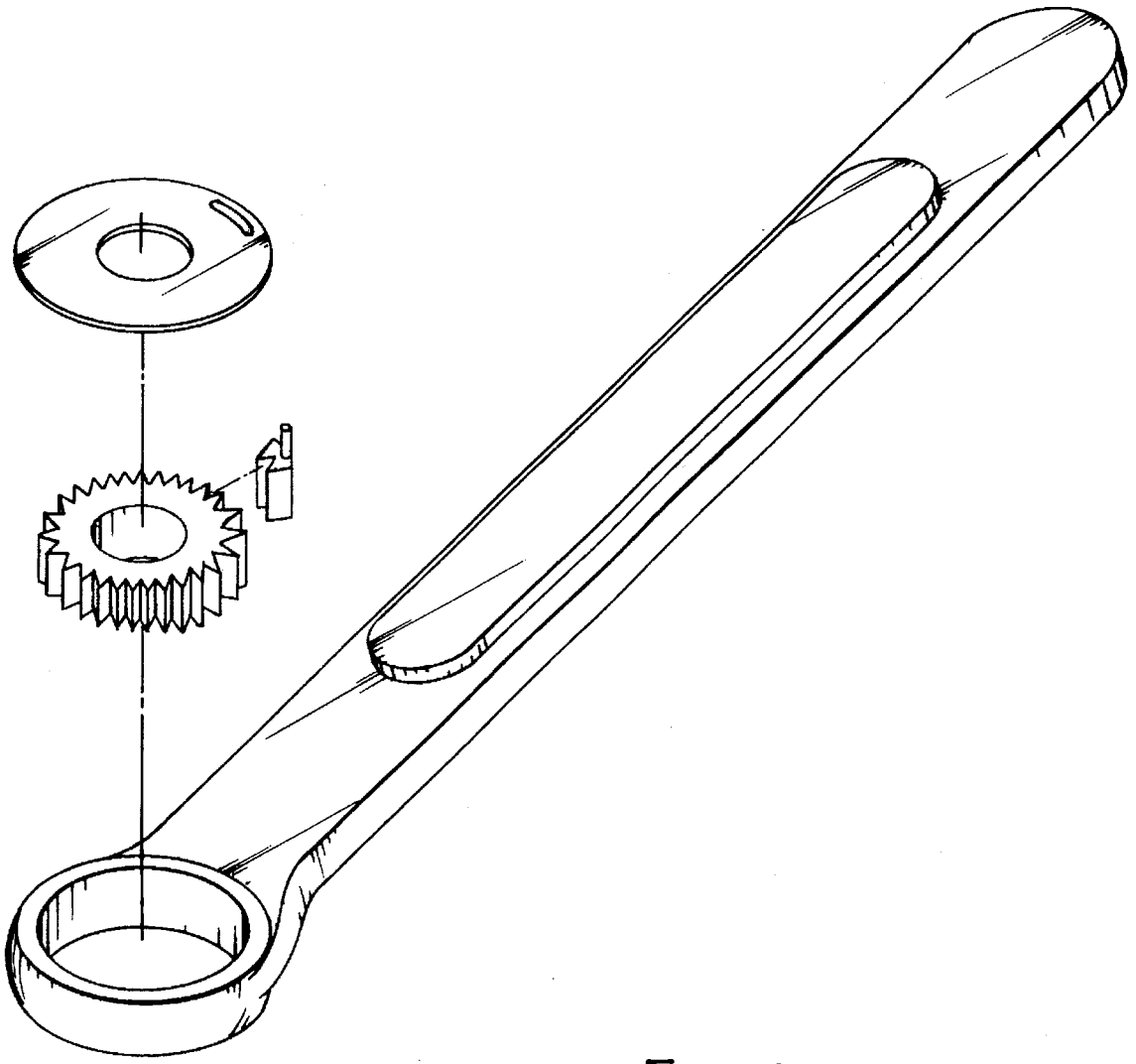
Fig. 1 PRIOR ART
FIG. 1 is an exploded view of a reversible socket wrench according to the prior art.
Figure 2:
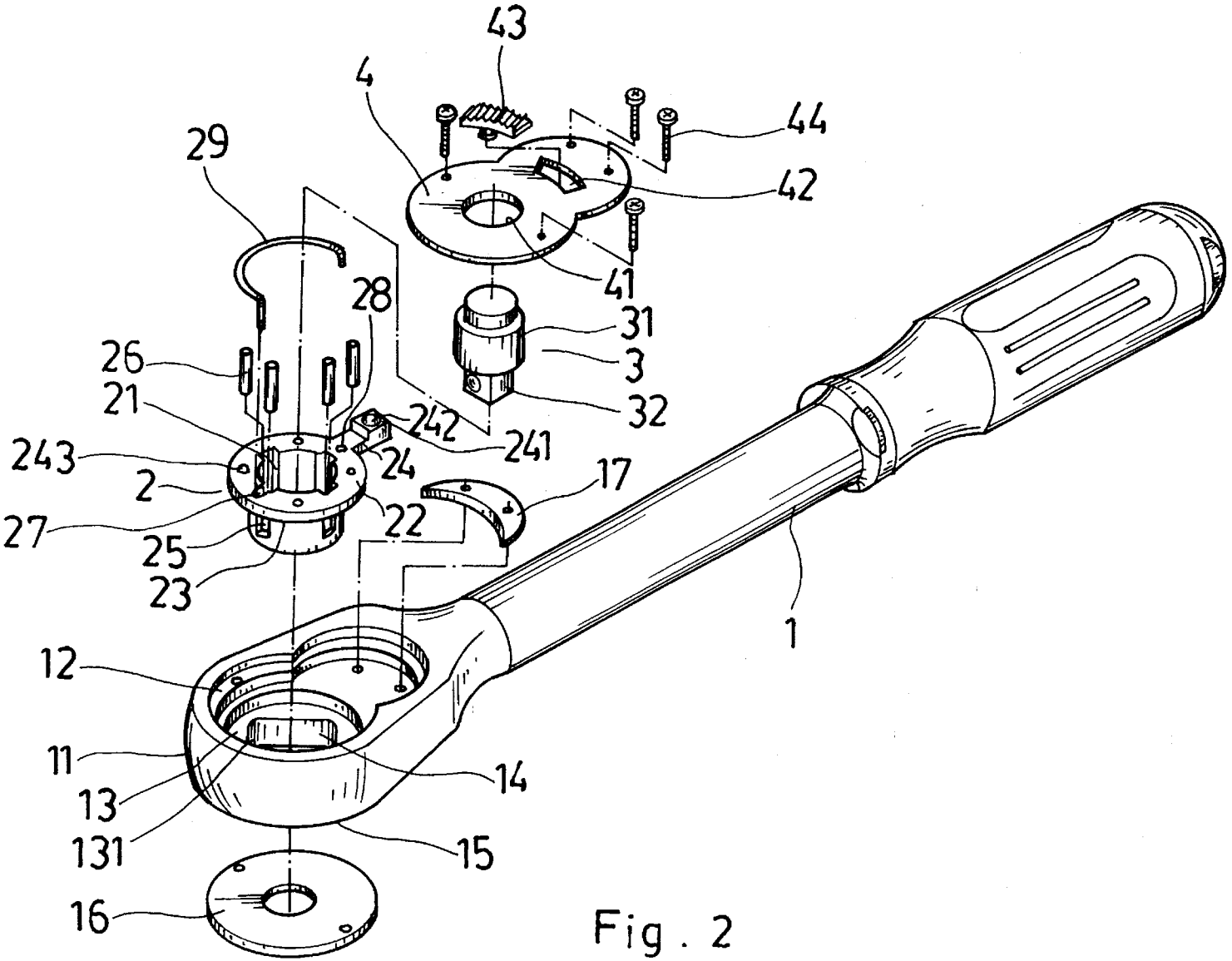
FIG. 2 is an exploded view of a reversible socket wrench according to the present invention.
Figure 3A:
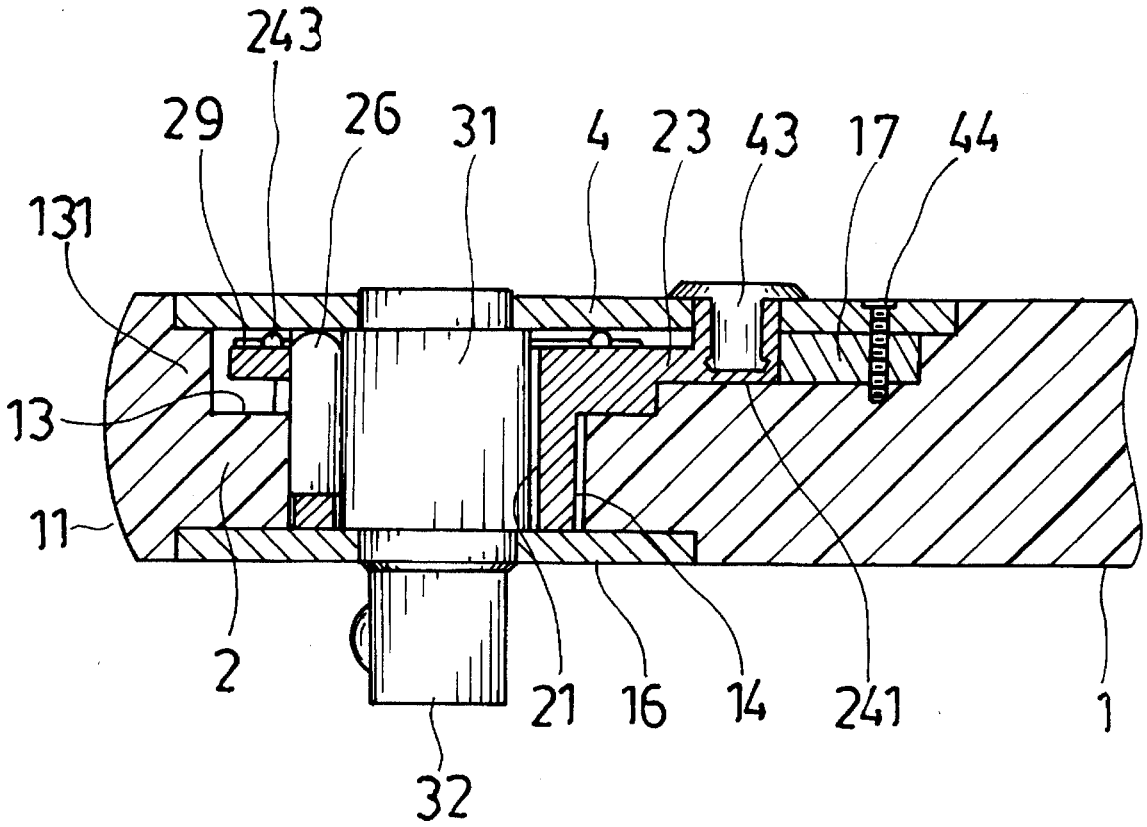
FIG. 3A is a sectional assembly view of the reversible socket wrench shown in FIG. 2.

Referring to FIGS. 2 and 3A, the handle, referenced by 1, terminates in a box end 11. The box end 11 comprises a substantially 8-shaped top recess 10, a mounting groove 12 around the peripheral wall of the 8-shaped top recess 10 at the top, a circular recess 13 on the front half of the 8-shaped top recess 10 below the elevation of the mounting groove 12, a projecting portion 131 raised from the peripheral wall of the 8-shaped top recess 10 and projecting into the circular recess 13, a square through hole 14 through the circular recess 13. The box end 11 further comprises a circular bottom recess 15 fixedly covered with an annular bottom cover plate 16. A adapter holder 2 is mounted within the box end 11 and inserted into the square through hole 14. The adapter holder 2 comprises a center through hole 21, an outward top flange 22, a half-round block 23 raised from the bottom side of the outward top flange 22 around the periphery of the adapter holder 2, a lever 24 horizontally extended from the border of the outward top flange 22 and terminating in a coupling end 241 with a mounting hole 242, a plurality of raised portions 243 raised from the top side of the outward top flange 22 and equiangularly spaced from one another, a plurality of roller bearing holes 25 spaced around the periphery in communication with the center through hole 21, a plurality of roller bearings 26 respectively mounted within the roller bearing holes 25, a top through hole 27 through the outward top flange 22 in communication with one roller bearing hole 25 remote from the lever 24, and a hook hole 28 on the outward top flange 22 near the lever 24. When the adapter holder 2 is inserted into the square through hole 14 with the half-round block 23 fitted into the circular recess 13, a crescent plate 17 is mounted within the rear half of the 8-shaped top recess 10 and abutted against the periphery of the coupling end 241 of the lever 24, then a locating spring wire 29 is fastened to the adapter holder 2 and supported on the raised portions 243 by inserting its front end through the top through hole 27 into the circular recess 13 and stopping it at the projecting portion and then inserting its rear end into the hook hole 28, and then an adapter 3 is fastened to the center through hole 21 of the adapter holder 2 with its stepped circular top section 31 fitted into the center through hole 21 and retained by the roller bearings 26 and its square bottom section 32 extended out of the box end 11 through the annular cover plate 16 for mounting any of a variety of sockets, and then a top cover plate 4 is securely fixed to the mounting groove 12 by screws 44 to hold down the crescent plate 17, the adapter holder 2, the locating spring wire 29 and the adapter 3. The top cover plate 4 comprises a circular hole 41, which receives the reduced top end of the adapter 3, and an arched slot 42, which receives the coupling end 241 of the lever 24 for allowing a slide 43 to be fastened to the mounting hole 242 and moved within the arched slot 42 to adjust the position of the adapter holder 2 in the box end 11.

Figure 3B:
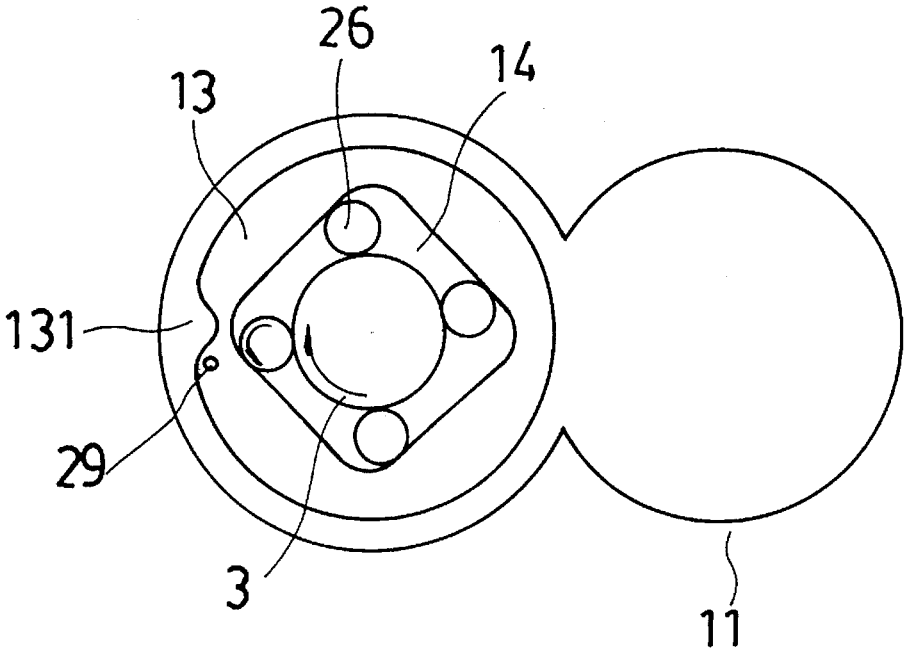
FIG. 3B shows the reversible socket wrench of the present invention turned clockwise.
Figure 3C:
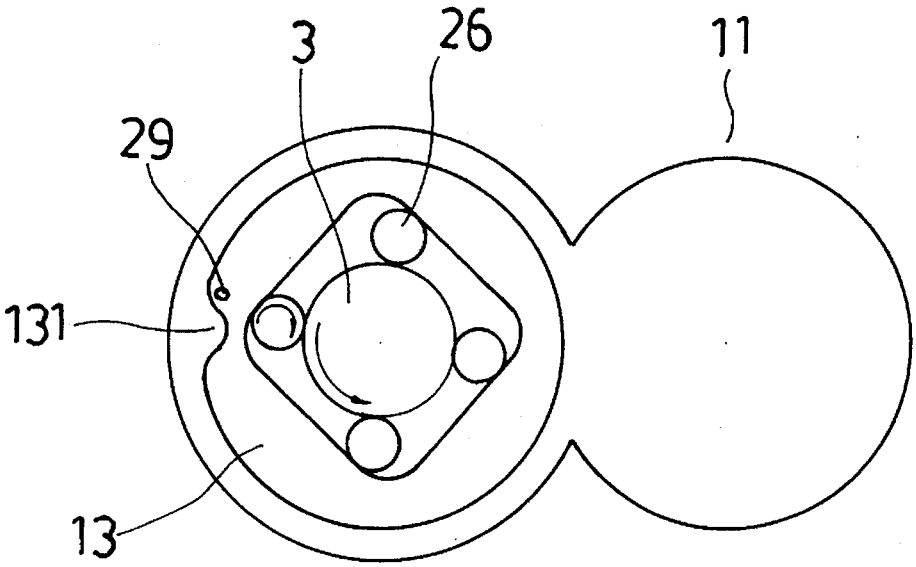
FIG. 3C shows the reversible socket wrench of the present invention turned counterclockwise.

Referring to FIGS. 3A, 3B, and 3C, when the slide 43 is moved to one end of the arched slot 42, the adapter holder 2 is relatively turned on its own axis, causing the locating spring wire 29 moved sideways relative to the raised portions 243. When the handle 1 is turned after the adjustment of the adapter holder 2, the roller bearings 26 are turned in the reversed direction relative to the adapter 3 and then retained in position to hold down the adapter 3. When the adapter 3 is held down tightly, the handle 1 can be continuously rotated to turn the workpiece. When the slide 43 is moved to the opposite end, the socket wrench can be driven to turn the workpiece in the reversed direction.

I claim:

1. A reversible socket wrench comprising a handle having a box end, an adapter for mounting a socket for turning a workpiece, an adapter holder mounted within said box end and covered with a top cover plate to hold said adapter, a crescent plate mounted within said box end to guide rotary motion of said adapter holder in said box end, a locating spring wire fastened to said adapter holder to hold it in position, and a slide coupled to said adapter holder for moving said adapter holder between a forward operating position and a backward operating position, wherein said box end comprises a substantially 8-shaped top recess, a mounting groove around the peripheral wall of said 8-shaped top recess at the top, a circular recess on a front half of said 8-shaped top recess below the elevation of said mounting groove, a projecting portion raised from the peripheral wall of said 8-shaped top recess and projecting into said circular recess, a square through hole through said circular recess, a circular bottom recess, and an annular bottom cover plate securely fixed to said circular bottom recess; said adapter holder is inserted into said square through hole, comprising a center through hole, an outward top flange disposed in said 8-shaped top recess, a half-round block raised from a bottom side of said outward top flange and fitted into said circular recess, a lever horizontally extended from the border of said outward top flange and terminating in a coupling end with a mounting hole, a plurality of raised portions raised from said outward top flange and equiangularly spaced from one another, a plurality of roller bearing holes spaced around the periphery in communication with said center through hole, a plurality of roller bearings respectively mounted within said roller bearing holes, a top through hole and a hook hole made through said outward top flange at two opposite locations; said adapter comprises a stepped circular top section retained in the center through hole on said adapter holder by said roller bearings, and a square bottom section for mounting a socket for turning a workpiece; said crescent plate is mounted within a rear half of said 8-shaped top recess and abutted against the periphery of said coupling end of said lever; said locating spring wire is bridged over the raised portions on said adapter holder, having one end inserted through said top through hole into said circular recess and stopped at said projecting portion and an opposite end into said hook hole; said top cover plate is securely fixed to said mounting groove on said box end, having a circular hole, which receives said stepped circular top section, and an arched slot, which receives said coupling end of said lever; said slide is fastened to the mounting hole on said coupling end of said lever and moved within said arched slot between said forward operating position for allowing said adapter holder to be turned by said handle clockwise, and said backward operating position for allowing said adapter holder to be turned by said handle counter-clockwise.

* * * * *